US011621507B2

(12) United States Patent
Hung

(10) Patent No.: US 11,621,507 B2
(45) Date of Patent: Apr. 4, 2023

(54) ELECTRICAL CONNECTOR

(71) Applicant: Dongguan Luxshare Technologies Co., Ltd, Dongguan (CN)

(72) Inventor: Yung-Chih Hung, Taipei (TW)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 50 days.

(21) Appl. No.: 17/347,189

(22) Filed: Jun. 14, 2021

(65) Prior Publication Data

US 2021/0408703 A1 Dec. 30, 2021

(30) Foreign Application Priority Data

Jun. 24, 2020 (CN) ..... 202010587704.9

(51) Int. Cl.
*H01R 12/58* (2011.01)
*H01R 12/73* (2011.01)
*H01R 13/40* (2006.01)

(52) U.S. Cl.
CPC ..... *H01R 12/585* (2013.01); *H01R 12/73* (2013.01); *H01R 13/40* (2013.01)

(58) Field of Classification Search
CPC ..... H01R 12/585; H01R 12/73; H01R 13/40; H01R 12/724; H01R 13/41; H01R 12/58; H01R 12/71; H01R 13/02
See application file for complete search history.

(56) References Cited

U.S. PATENT DOCUMENTS 6,095,826 A * 8/2000 Potters ..... H01R 12/724 439/79
11,456,547 B2 * 9/2022 Su ..... H01B 7/0045
2005/0277312 A1 * 12/2005 Nakamura ..... H01R 12/585 439/82
2009/0221190 A1 * 9/2009 Ambo ..... H01R 13/516 439/701
2013/0109224 A1 * 5/2013 Chin ..... H01R 12/7088 439/485
2016/0276761 A1 9/2016 Endo et al.
(Continued)

FOREIGN PATENT DOCUMENTS

CN 202067937 U 12/2011
CN 202159789 U 3/2012
(Continued)

*Primary Examiner* — Truc T Nguyen
(74) *Attorney, Agent, or Firm* — Birch, Stewart, Kolasch & Birch, LLP

(57) ABSTRACT

The present disclosure provides an electrical connector comprising a connector body and a plurality of terminals. The connector body comprises a plugging slot and a plurality of terminal slots. The plurality of the terminal slots communicate with the plugging slot. A lower wall of each of the terminal slots comprises an accommodating recess. At least one limiting bump is disposed on an end surface of the accommodating recess. The plurality of terminals are respectively disposed in the corresponding terminal slots. Each of the terminals comprises a terminal body, a plugging end part, and a connecting end part. The terminal body is disposed in the terminal slot. The plugging end part is disposed in the plugging slot. The connecting end part is disposed on a rear surface of the connector body.

11 Claims, 15 Drawing Sheets

(56) References Cited

U.S. PATENT DOCUMENTS

| | | | | |
|---|---|---|---|---|
| 2019/0067880 | A1* | 2/2019 | Zhang | H01R 13/6585 |
| 2021/0408734 | A1* | 12/2021 | Hung | H01R 13/502 |

FOREIGN PATENT DOCUMENTS

| | | | |
|---|---|---|---|
| CN | 202423596 | U | 9/2012 |
| CN | 104300311 | A | 1/2015 |
| CN | 205178171 | U | 4/2016 |
| CN | 206461121 | U | 9/2017 |
| CN | 107528162 | A | 12/2017 |
| CN | 207781944 | U | 8/2018 |
| TW | M379241 | U1 | 4/2010 |
| TW | 201318274 | A1 | 5/2013 |
| TW | M506398 | U | 8/2015 |
| TW | M542264 | U | 5/2017 |

* cited by examiner

ELECTRICAL CONNECTOR

CROSS-REFERENCE TO RELATED APPLICATION

This application claims the priority benefit of Chinese Patent Application Serial Number 202010587704.9, filed on Jun. 24, 2020, the full disclosure of which is incorporated herein by reference.

BACKGROUND

Technical Field

The present disclosure relates to the technical field of connector, particularly to an electrical connector.

Related Art

Conventional connectors comprise a connector body, a plurality of power terminals, and a plurality of signal terminals. The plurality of power terminals and the plurality of signal terminals are inserted into the connector body. The plurality of power terminals and the plurality of signal terminals are partially exposed at the outside of the connector body to which that the partial plurality of power terminals and the plurality of signal terminals are not fixed. When the connector is connected to a circuit board through the plurality of power terminals and the plurality of signal terminals, the plurality of power terminals and the plurality of signal terminals are prone to be displaced.

SUMMARY

The embodiments of the present disclosure provide an electrical connector tended to solve the problem of displacement of terminals when the connector is installed on the circuit board through the terminal due to the unfixed terminals exposed from the connector body of the connector.

The present disclosure provides an electrical connector, comprising a connector body and a plurality of terminals. The connector body comprises a plugging slot and a plurality of terminal slots. The plurality of the terminal slots communicate with the plugging slot. A lower wall of each of the terminal slots comprises an accommodating recess. At least one limiting bump is disposed on an end surface of the accommodating recess. The plurality of terminals are respectively disposed in the corresponding terminal slots. Each of the terminals comprises a terminal body, a plugging end part, and a connecting end part. The terminal body is disposed in the terminal slot. The plugging end part is disposed in the plugging slot. The connecting end part is disposed on a rear surface of the connector body. The connecting end part comprises at least two bent connecting members. A limiting gap exists between two adjacent bent connecting members. The at least two bent connecting members are connected to the terminal body. Each of the limiting bumps passes through the corresponding limiting gap between two adjacent bent connecting members.

In the embodiments of the present disclosure, by disposing an accommodating notch on the lower wall of the terminal slot and by disposing at least one limiting bump in the accommodating notch, the terminals exposed from the connector body can be restricted from moving toward the upper surface of the connector body. Thus, the terminal could avoid being pressed and move upward when the electrical connector is connected to the circuit board.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 5:
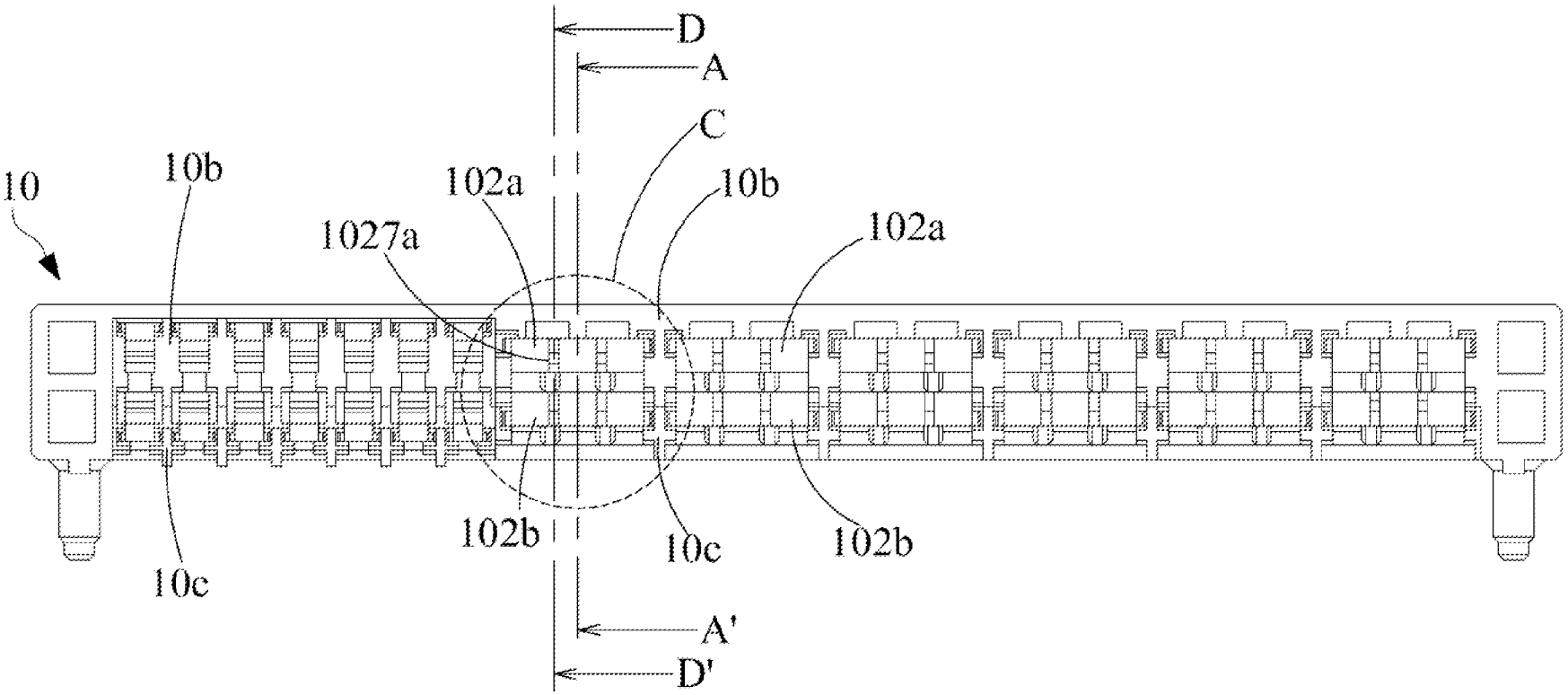
FIG. 5 is a rear view of a connector body of the first embodiment of the present disclosure.
Figure 6:
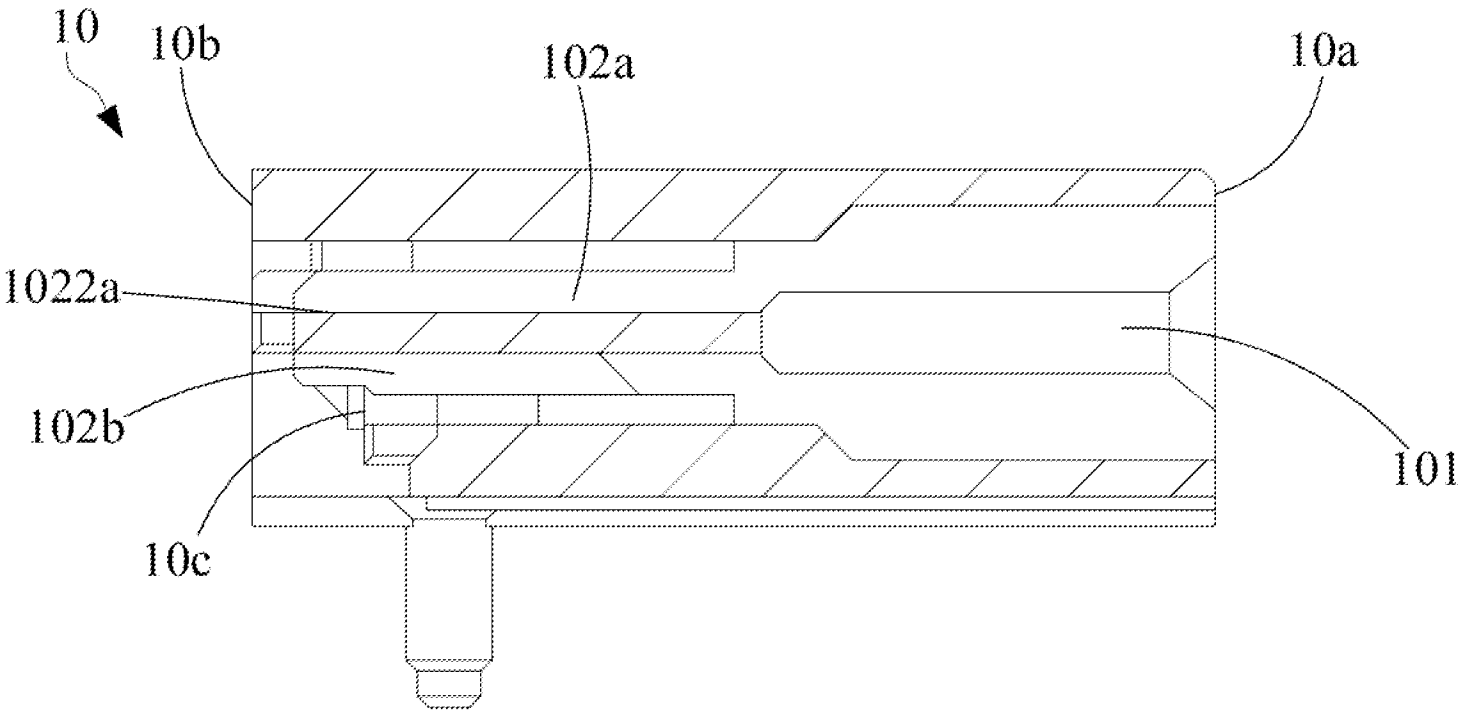
FIG. 6 is a cross-sectional view along line A-A' in FIG. 5.

FIG. 1 to FIG. 4 are perspective view, rear views, exploded view of an electrical connector of the first embodiment of the present disclosure. FIG. 5 is a rear view of a connector body of the first embodiment of the present disclosure. As shown in the figures, the electrical connector 1 of this embodiment comprises a connector body 10 and a plurality of terminals. The connector body 10 comprises a plugging slot 101 and a plurality of terminal slots. The plugging slot 101 is disposed on the front side of the connector body 10, and the plurality of terminal slots are disposed on the rear side of the connector body 10. The plurality of terminal slots communicate with the plugging slot 101. The connector body 10 comprises a front surface 10*a* and a rear surface. The plugging slot 101 penetrates the front surface 10*a* of the connector body 10, and the plurality of terminal slots penetrate the rear surface of the connector body 10. FIG. 6 is a cross-sectional view along line A-A' in FIG. 5. As shown in the figure, the rear surface of the connector body 10 comprises a first rear surface 10*b* and a second rear surface 10*c*. The first rear surface 10*b* is disposed above the second rear surface 10*c*. The distance between the first rear surface 10*b* and the front surface 10*a* is greater than the distance between the second back surface 10*c* and the front surface 10*a*, which indicates that the cross-section area of the rear surface of the connector body 10 is step-shaped.

Back to FIG. 5, the plurality of terminal slots comprises a plurality of first power terminal slots 102*a* and a plurality of second power terminal slots 102*b*. The plurality of first power terminal slots 102*a* penetrate the first rear surface 10*b* (see FIG. 6). The plurality of first power terminal slots 102*a* are arranged in a row at intervals on the first rear surface 10*b*. The plurality of second power terminal slots 102*b* penetrate the second rear surface 10*c* (see FIG. 6). The plurality of second power terminal slots 102*b* are arranged in a row at intervals on the second rear surface 10*c*. The plurality of first power terminal slots 102*a* are disposed above the plurality of second power terminal slots 102*b*. The plurality of first power terminal slots 102*a* are close to an upper surface of the connector body 10. The plurality of second power terminal slots 102*b* are close to a lower surface of the connector body 10. The plurality of first power terminal slots 102*a* respectively correspond to the plurality of second power terminal slots 102*b*.

Figure 1:
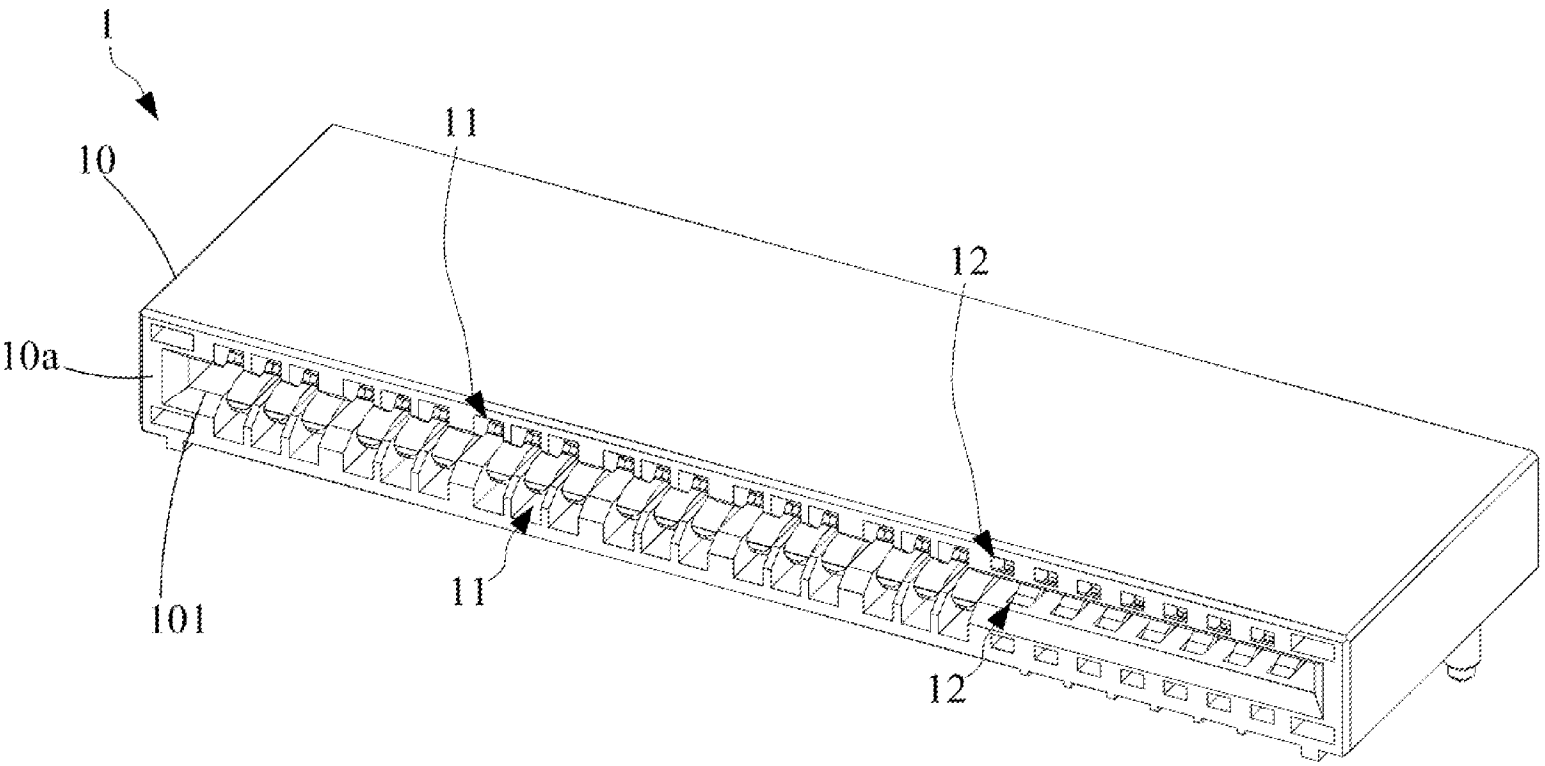
FIG. 1 is a perspective view of an electrical connector of the first embodiment of the present disclosure.
Figure 2:
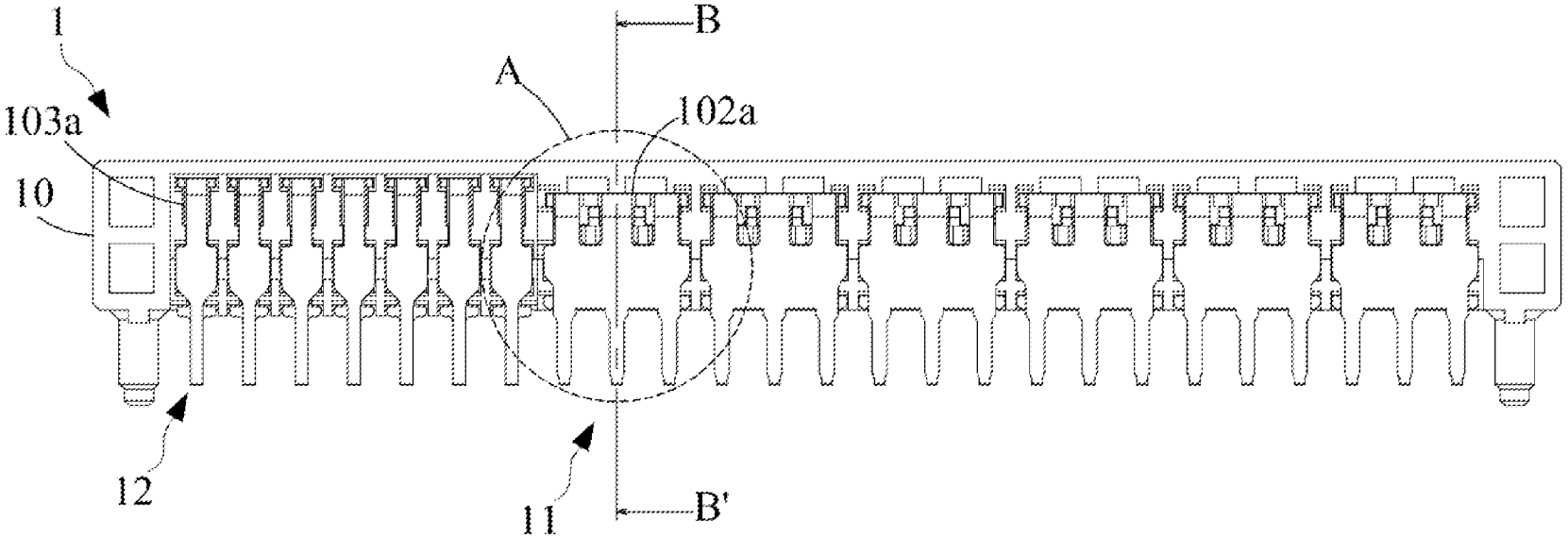
FIG. 2 is a rear view of the electrical connector of the first embodiment of the present disclosure.
Figure 7:
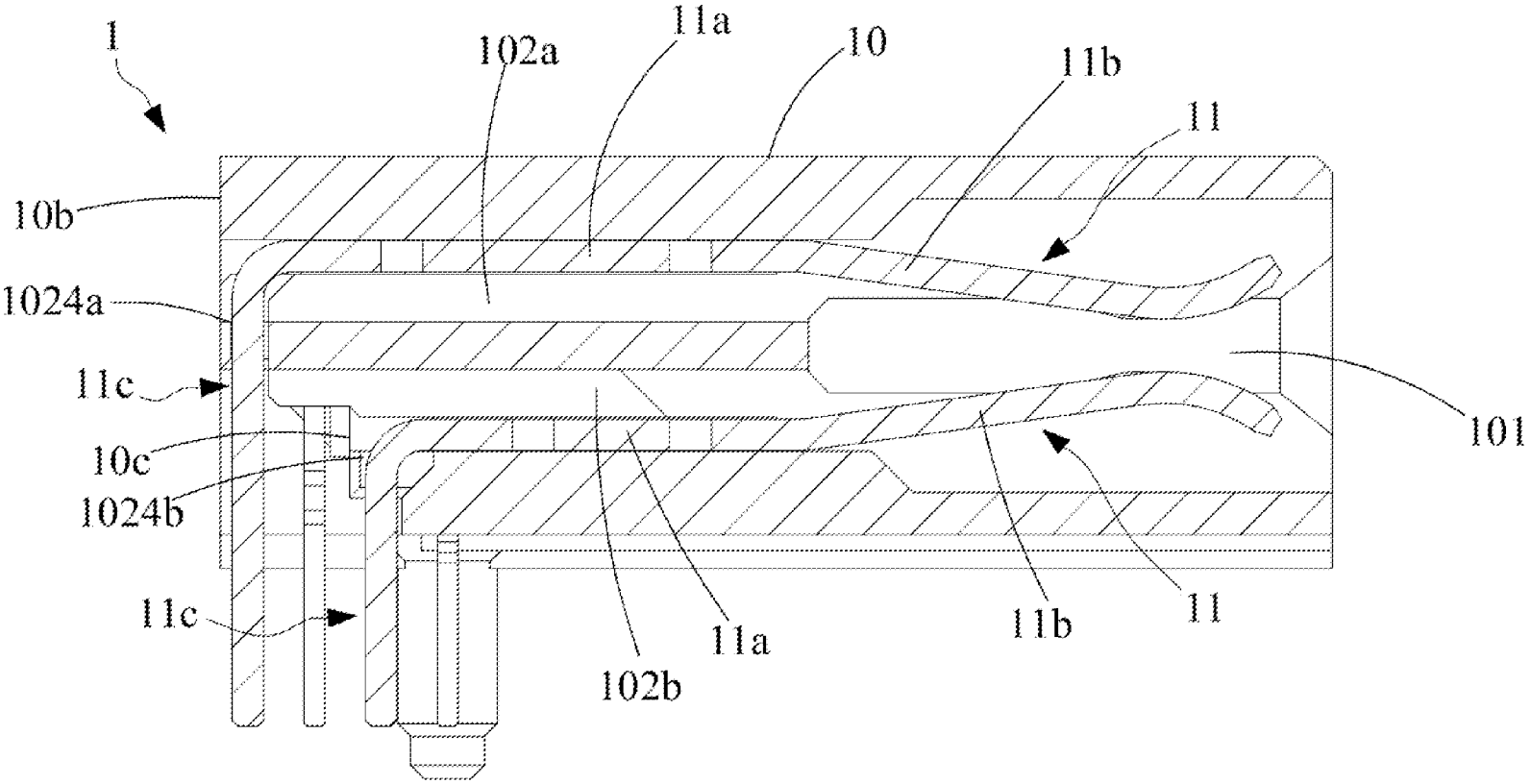
FIG. 7 is a cross-sectional view along line B-B' in FIG. 2.

FIG. 7 is a cross-sectional view along line B-B' in FIG. 2. As shown in the figure, the plurality of power terminals 11 are respectively disposed in the corresponding first power terminal slot 102*a* or the second power terminal slot 102*b*. One end of each of the power terminals 11 extends into the plugging slot 101, and the other end of each of the power terminals 11 is disposed on the rear surface of the connector body 10. Each of the power terminals 11 comprises a terminal body 11*a*, a plugging end part 11*b*, and a connecting end part 11*c*. The plugging end part 11*b* and the connecting end part 11*c* are respectively disposed at two ends of the terminal body 11*a*. When the power terminal 11 is disposed in the power terminal slot (the first power terminal slot 102*a* or the second power terminal slot 102*b*), the terminal body 11*a* would be disposed in the power terminal slot, the plugging end part 11*b* would be disposed in the plugging slot 101 and the power terminal slot, and the connecting end part 11*c* would protrude from the rear surface of the connector body 10 and would be disposed on the rear surface of the connector body 10. For example, the connecting end part 11*c* of the power terminal 11 in the first power terminal slot 102*a* would be disposed on the first rear surface 10*b* of the connector body 10, and the connecting end part 11*c* of the power terminal 11 in the second power terminal slot 102*b* would be disposed on the second rear surface 10*c* of the connector body 10. In this embodiment, since a gap exists between the first rear surface 10*b* and the second rear surface 10*c* of the connector body 10, a gap exists between the connecting end part 11*c* of the power terminal 11 in the first power terminal slot 102*a* and the connecting end part 11*c* of the power terminal 11 in the second power terminal slot 102*b*. In this way, the plurality of power terminals 11 in the plurality of first power terminal slots 102*a* can be prevented from contacting with the plurality of power terminals 11 in the plurality of second power terminal slots 102*b*.

Figure 3:
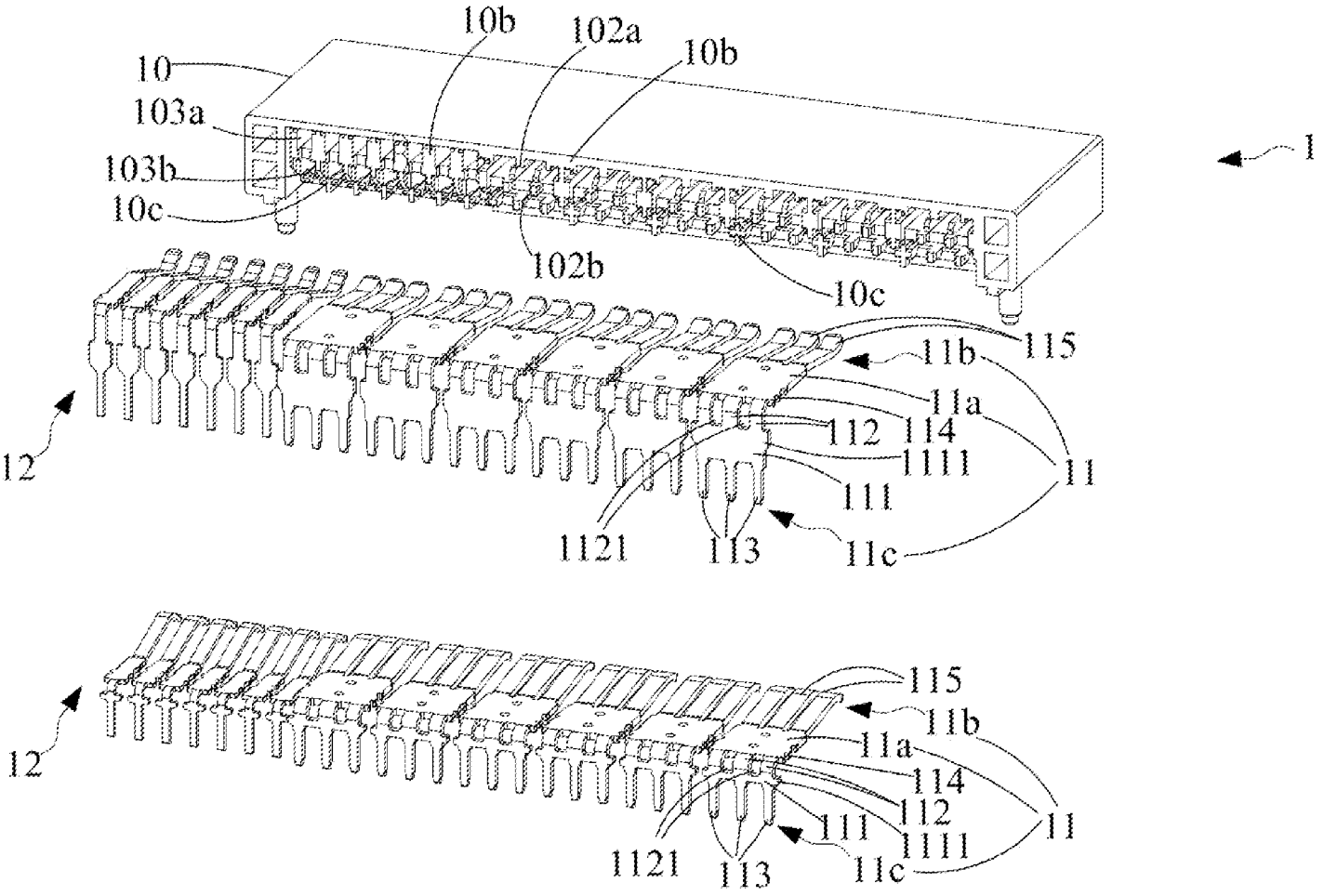
FIG. 3 is an exploded view of the electrical connector of the first embodiment of the present disclosure.
Figure 4:
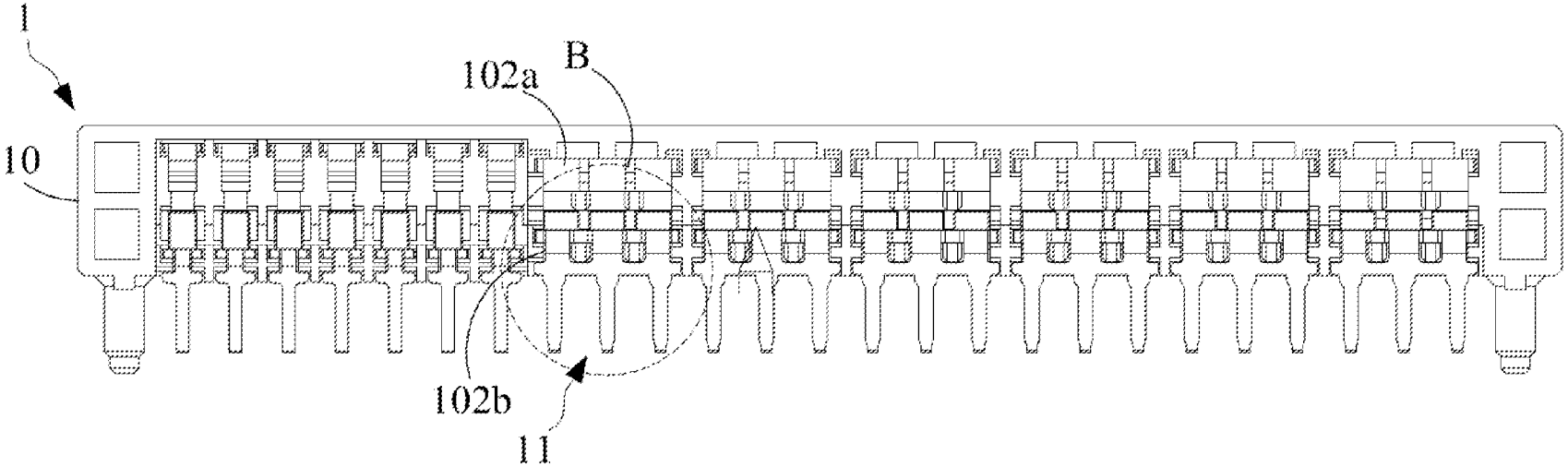
FIG. 4 is another rear view of the electrical connector of the first embodiment of the present disclosure.
Figure 8:
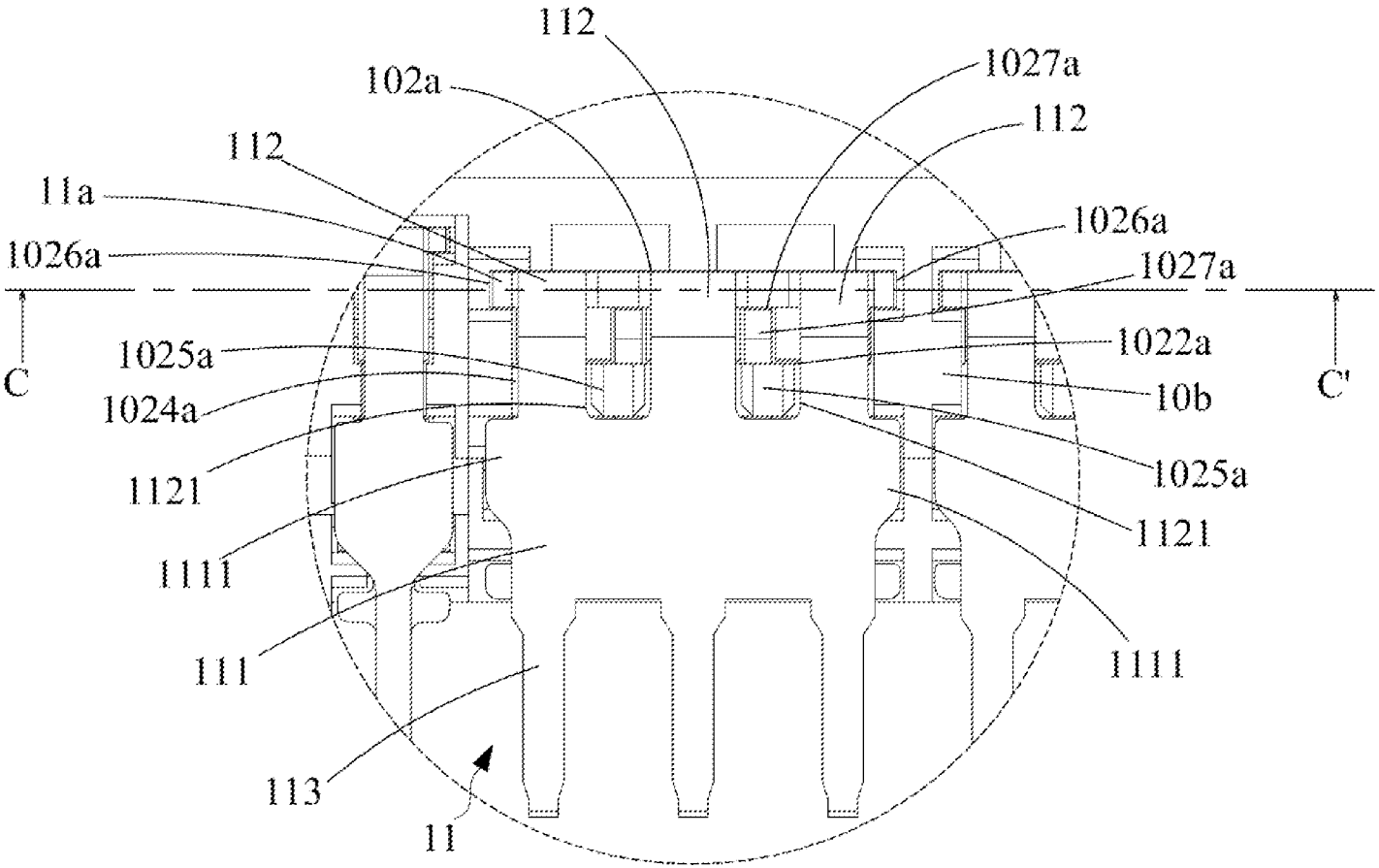
FIG. 8 is an enlarged view of area A in FIG. 2.
Figure 9:
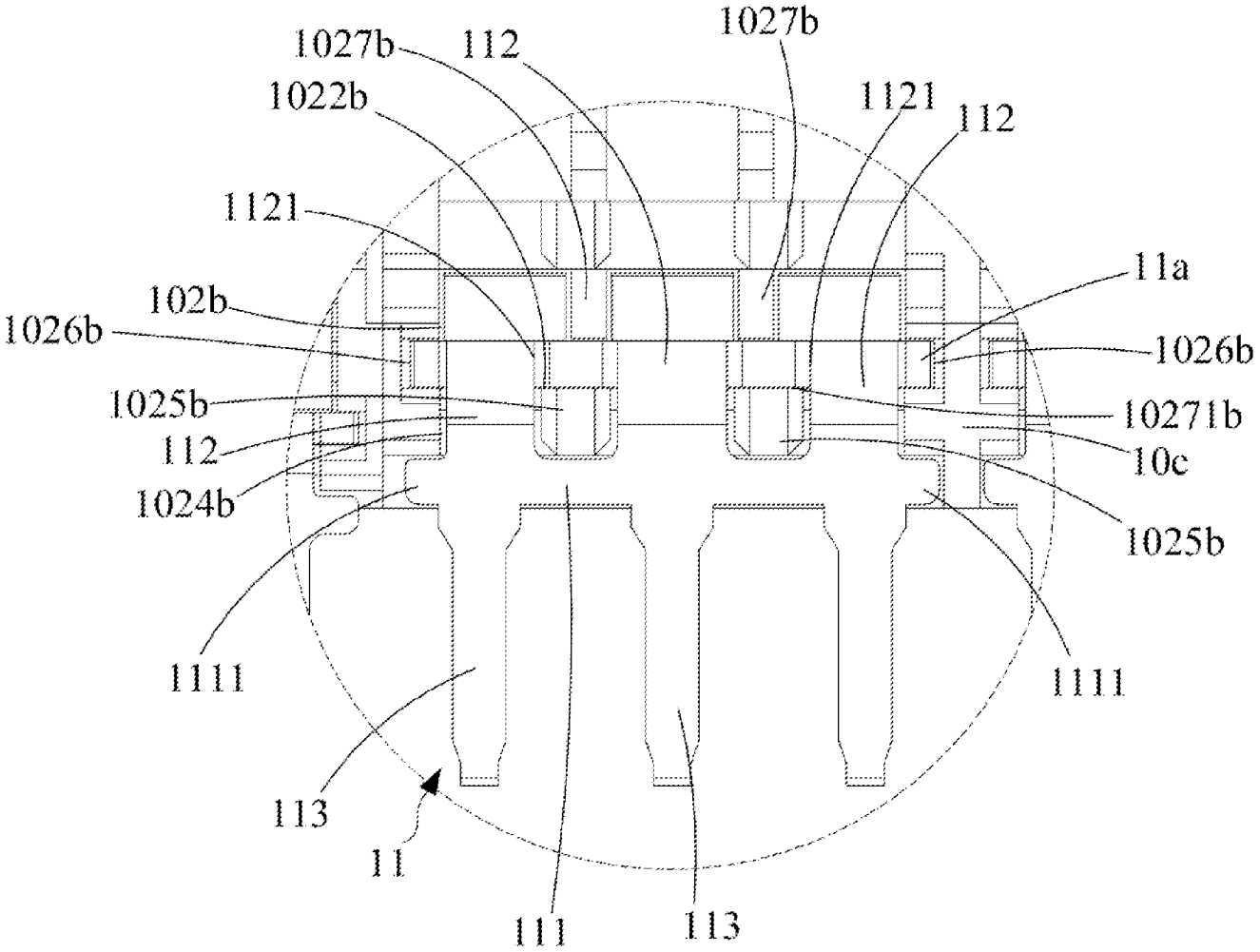
FIG. 9 is an enlarged view of area B in FIG. 4.

Back to FIG. 3, the connecting end part 11*c* of each of the power terminals 11 comprises a connecting body 111, a plurality of bent connecting members 112, and a connecting pin 113. The connecting body 111 is connected to the terminal body 11*a* through the plurality of bent connecting members 112. The plurality of bent connecting members 112 are disposed between the connecting body 111 and the terminal body 11*a* at intervals. The extending direction of the connecting body 111 is perpendicular to the extending direction of the terminal body 11*a*. The connecting pin 113 is disposed at one end of the connecting body 111 away from the plurality of bent connecting members 112. The extending direction of the connecting pin 113 is parallel to the extending direction of the connecting body 111. In this way, each of the power terminals 11 can be bent-shaped. FIG. 8 is an enlarged view of area A in FIG. 2. FIG. 9 is an enlarged view of area B in FIG. 4. As shown in the figure, when the power terminal 11 is disposed in the corresponding power terminal slot, the connecting body 111 would be disposed on the rear surface of the connector body 10. For example, the connecting body 111 of the power terminal 11 in the first power terminal slot 102*a* is disposed on the first rear surface 10*b* of the connector body 10, and the connecting body 111 of the power terminal 11 in the second power terminal slot 102*b* is disposed on the second rear surface 10*c* of the connector body 10.

Specifically, in this embodiment, the number of the bent connecting members 112 of the connecting end part 11*c* of the power terminal 11 is three. The three bent connecting members 112 comprise two limiting gaps 1121. In this embodiment, the number of connecting pins 113 is three. The three connecting pins 113 correspond to the three bent connecting members 112, respectively. The connecting pin 113 is produced to be plate-shaped to be soldered onto an external circuit board. The power terminal 11 of this embodiment is integrally formed as a one-piece component, which comprises been purposely divided into multiple parts only for the description of the structural configuration.

Figure 10:
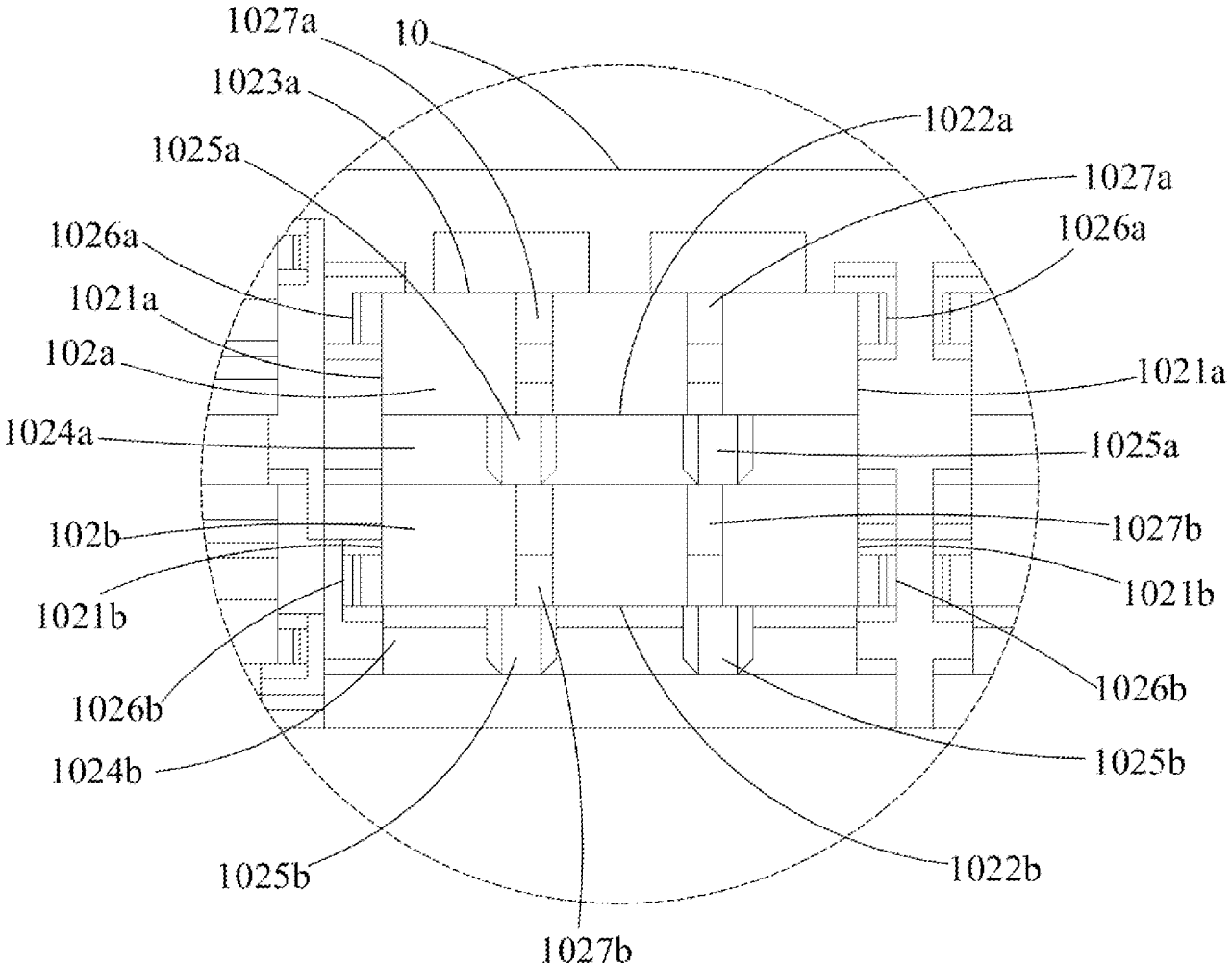
FIG. 10 is an enlarged view of area C in FIG. 5.

FIG. 10 is an enlarged view of area C in FIG. 5. As shown in the figure, in this embodiment, the first power terminal slot 102*a* comprises two first sidewalls 1021*a*, a first lower wall 1022*a*, and a first upper wall 1023*a*. The two first sidewalls 1021*a* are oppositely disposed. The first lower wall 1022*a* and the first upper wall 1023*a* are oppositely disposed and are disposed between the two first sidewalls 1021*a*. The second power terminal slot 102*b* comprises two second sidewalls 1021*b* and a second lower wall 1022*b*. The two second sidewalls 1021*b* are oppositely disposed. The second lower wall 1022*b* is disposed between the two second sidewalls 1021*b* and corresponds to the first lower wall 1022*a*. The first lower wall 1022*a* of the first power terminal slot 102*a* could also be an upper wall of the second power terminal slot 102*b*. Besides, since the first rear surface 10*b* of the connector body 10 is farther than the second rear surface 10*c* of the connector body 10 away from the front surface 10*a* of the connector body 10, the first lower wall 1022*a* of the first power terminal slot 102*a* protrudes in a direction away from the front surface 10*a* (see FIG. 6) from the second rear surface 10*c*.

In this embodiment, the first lower wall 1022*a* of the first power terminal slot 102*a* comprises a first accommodating recess 1024*a*. When the power terminal 11 is disposed in the first power terminal slot 102*a*, the three bent connecting members 112 of the connecting end part 11*c* of the power terminal 11 would be accommodated in the first accommodating recess 1024*a* (see FIG. 8). The distance between an end surface of the first accommodating recess 1024*a* parallel to the first rear surface 10*b* and the first rear surface 10*b* is greater than or equal to the thickness of the bent connecting members 112. Thus, the connecting member 112 can be completely disposed in the first accommodating recess 1024*a* (see FIG. 6) to prevent the bent connecting member 112 from protruding from the first rear surface 10*b*.

Similarly, the first lower wall 1022*b* of the second power terminal slot 102*b* comprises two second accommodating recesses 1024*b*. When the power terminal 11 is disposed in the second power terminal slot 102*b*, the three bent connecting members 112 of the connecting end part 11*c* of the power terminal 11 would be accommodated in the second accommodating recess 1024*b* (see FIG. 9). The distance between a surface of the second accommodating recess 1024*b* parallel to the second rear surface 10*c* and the second rear surface 10*c* is greater than or equal to the thickness of the bent connecting members 112. Thus, the bent connecting member 112 can be completely disposed in the second accommodating recess 1024*b* (see FIG. 6) to prevent the bent connecting member 112 from protruding from the second rear surface 10*c*.

In one embodiment, the width of the first accommodating recess 1024*a* is equal to the width between the two outermost edges of each of the three bent connecting members 112 of the power terminal 11 in the first power terminal slot 102*a* (see FIG. 8). The width of the second accommodating recess 1024*b* is equal to the width between the two outermost edges of each of the three bent connecting members 112 of the power terminal 11 in the second power terminal slot 102*b* (see FIG. 9). Thus, the three bent connecting members 112 of each of the power terminals 11 can be restricted to move only in the first accommodating recess 1024*a* or the second accommodating recess 1024*b*.

In this embodiment, an end surface of the first accommodating recess 1024*a* further comprises two first limiting blocks 1025*a* disposed at intervals. When the power terminal 11 is disposed in the corresponding first power terminal slot 102*a*, each of the first limiting blocks 1025*a* in the first accommodating recess 1024*a* passes through the limiting gap 1121 between two adjacent bent connecting members 112 of the power terminal 11. The first limiting block 1025*a* abuts against the connecting body 111 of the power terminal 11 to position the location of the connecting body 111. In this way, it is possible to keep the connecting end part 11*c* of the power terminal 11 in the first power terminal slot 102*a* from moving toward the upper surface of the connector body 10.

Similarly, an end surface of the second accommodating recess 1024*b* further comprises two second limiting blocks 1025*b* disposed at intervals. When the power terminal 11 is disposed in the corresponding second power terminal slot 102*b*, each of the second limiting blocks 1025*b* in the second accommodating recess 1024*b* passes through the limiting gap 1121 between two adjacent bent connecting members 112 of the power terminal 11. The second limiting block 1025*b* abuts against the connecting body 111 of the power terminal 11 to position the location of the connecting body 111. In this way, it is possible to keep the connecting end part 11*c* of the power terminal 11 in the second power terminal slot 102*b* from moving toward the upper surface of the connector body 10.

In this embodiment, two sides of the connector body 111 of each of the power terminals 11 comprise a first positioning bump 1111, respectively. When the power terminal 11 is disposed in the corresponding first power terminal slot 102*a*, the two first positioning bumps 1111 abut against the lower surface of the first lower wall 1022*a* of the first power terminal slot 102*a* to keep the connecting body 111 of the power terminal 11 in the first power terminal slot 102*a* from moving toward the upper surface of the connector body 10. In this way, the power terminal 11 can be fixed in the corresponding first power terminal slot 102*a*. When the power terminal 11 is disposed in the corresponding second power terminal slot 102*b*, the two first positioning bumps 1111 abut against the lower surface of the second lower wall 1022*b* of the second power terminal slot 102*b* to keep the connecting body 111 of the power terminal 11 in the second power terminal slot 102*b* from moving toward the upper surface of the connector body 10. In this way, the power terminal 11 can be fixed in the corresponding second power terminal slot 102*b*.

In this embodiment, a surface of the first positioning bump 1111 close to the bent connecting members 112 is aligned with a surface of the connecting body 111 connecting with the bent connecting members 112. A surface of the first limiting block 1025*a* away from the first power terminal slot 102*a* is aligned with a lower surface of the first lower wall 1022*a* of the first power terminal slot 102*a*. A surface of the second limiting block 1025*b* away from the second power terminal slot 102*b* is aligned with a lower surface of the second lower wall 1022*b* of the second power terminal slot 102*b*. In this way, the surface connecting with the connecting body 111 and the bent connecting member 112 could be disposed below the lower surface of the first lower wall 1022*a* of the first power terminal slot 102*a* or the lower surface of the second lower wall 1022*b* of the second power terminal slot 102*b*.

Figure 11:
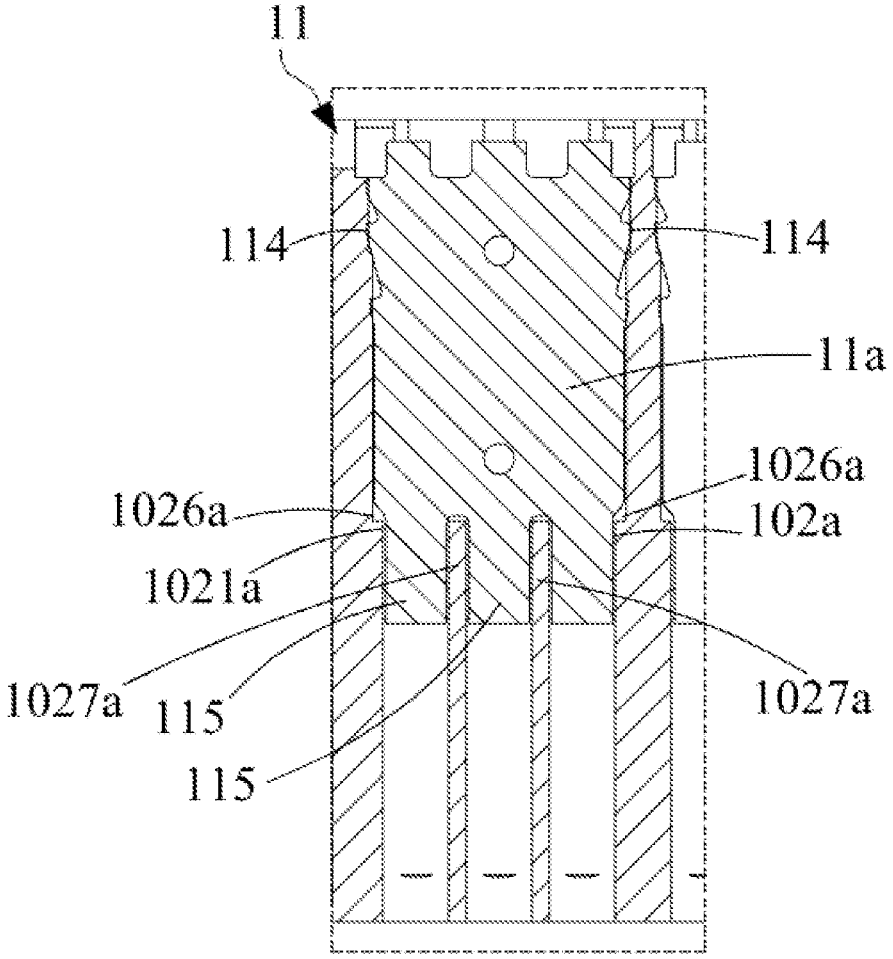
FIG. 11 is a cross-sectional view along line C-C' in FIG. 8.

In one embodiment, two first sidewalls 1021*a* of the first power terminal slot 102*a* comprise a first positioning groove 1026*a*, respectively. The two first positioning grooves 1026*a* are oppositely disposed. The two first positioning grooves 1026*a* extend along a direction perpendicular to the first rear surface 10*b* of the connector body 10 and penetrate the first rear surface 10*b* of the connector body 10. FIG. 11 is a cross-sectional view along line C-C' in FIG. 8. As shown in the figure, the width of the terminal body 11*a* of the power terminal 11 in the first power terminal slot 102*a* is wider than the width of the first power terminal slot 102*a*. The width between two surfaces of the two first positioning grooves 1026*a* perpendicular to the first rear surface 10*b* of the connector body 10 is greater or equal to the width of the terminal body 11*a* of the power terminal 11. When the power terminal 11 is disposed in the first power terminal slot 102*a*, the terminal body 11*a* of the power terminal 11 would be disposed in the two first positioning grooves 1026*a*, and one end of the terminal body 11*a* away from the first rear surface 10*b* would abut against the surfaces of the two first positioning grooves 1026*a* away from the first rear surface 10*b*. Thus, the power terminal 11 can be fixed in the first power terminal slot 102*a*.

Similarly, two second sidewalls 1021*b* of the second power terminal slot 102*b* comprise a second positioning groove 1026*b*, respectively. The two second positioning grooves 1026*b* are oppositely disposed. The two second positioning grooves 1026*b* extend along a direction perpendicular to the second rear surface 10*c* of the connector body 10 and penetrate the second rear surface 10*c* of the connector body 10. The width of the terminal body 11*a* of the power terminal 11 in the second power terminal slot 102*b* is wider than the width of the second power terminal slot 102*b*. The width between two surfaces of the two second positioning grooves 1026*b* perpendicular to the second rear surface 10*c* of the connector body 10 is greater or equal to the width of the terminal body 11*a* of the power terminal 11. When the power terminal 11 is disposed in the second power terminal slot 102*b*, the terminal body 11*a* of the power terminal 11 would be disposed in the two second positioning grooves 1026*b*, and one end of the terminal body 11*a* away from the second rear surface 10*c* would abut against the surfaces of the two second positioning grooves 1026*b* away from the second rear surface 10*c*. Thus, the power terminal 11 can be fixed in the second power terminal slot 102*b*.

In one embodiment, two sides of the terminal body 11*a* of each of the power terminals 11 comprise an interfering bump 114, respectively. When the power terminal 11 is disposed in the first power terminal slot 102*a*, the two interfering bumps 114 of the power terminal body 11*a* of the power terminal 11 would interfere with a sidewall of the first positioning groove 1026*a* (see FIG. 11) to fix the terminal body 11*a* of the power terminal 11 in the two first positioning grooves 1026*a*. In this way, the power terminal 11 can be fixed in the first power terminal slot 102*a*. Similarly, when the power terminal 11 is disposed in the second power terminal slot 102*b*, the two interfering bumps 114 of the power terminal body 11*a* of the power terminal 11 would interfere with a sidewall of the second positioning groove 1026*b* to fix the terminal body 11*a* of the power terminal 11 in the two second positioning grooves 1026*b*. In this way, the power terminal 11 can be fixed in the second power terminal slot 102*b*.

In one embodiment, the two first positioning grooves 1026*a* of the first power terminal slot 102*a* are close to the upper surface of the connector body 10, and the two second positioning grooves 1026*b* of the second power terminal slot 102*b* are close to the lower surface of the connector body 10. Thus, the terminal body 11*a* of the power terminal 11 is close to the upper surface of the connector body 10 under the restriction of the two first positioning grooves 1026*a*, and the plugging end part 11*b* connected with the terminal body 11*a* is disposed on the upper surface of the plugging slot 101; the terminal body 11*a* of the power terminal 11 is close to the lower surface of the connector body 10 under the restriction of the two second positioning grooves 1026*b*, and the plugging end part 11*b* connected with the terminal body 11*a* is disposed on the lower surface of the plugging slot 101. Therefore, the position of the power terminal 11 in the first power terminal slot 102*a* and the position of the power terminal 11 in the second power terminal slot 102*b* could be restricted by the positions of the two first positioning grooves 1026*a* and the positions of the two second positioning grooves 1026*b*.

In one embodiment, the plugging end part 11*b* of each of the power terminals 11 comprises three plugging elastic pieces 115. One ends of the three plugging elastic pieces 115 are connected to the terminal body 11*a* of the power terminal 11 and are disposed at intervals. In one embodiment, two first partition members 1027*a* are disposed in the first power terminal slot 102*a* at intervals. The two first partition members 1027*a* are connected to the first upper wall 1023*a* and the first lower wall 1022*a* of the first power terminal slot 102*a*. The two first partition members 1027*a* could divide the first power terminal slot 102*a* into three channels. The three plugging elastic pieces 115 of the power terminal 11 could respectively enter the plugging slot 101 through the corresponding channel (see FIG. 11). A second partition member 1027*b* is disposed in the second power terminal slot 102*b*. The second partition member 1027*b* is connected to the first lower wall 1022*a* of the first power terminal slot 102*a* and the second lower wall 1022*b* of the second power terminal slot 102*b*. The second partition member 1027*b* could divide the second power terminal slot 102*b* into three channels. The two plugging elastic pieces 115 of the power terminal 11 could respectively enter the plugging slot 101 through the corresponding channel.

Figure 12:
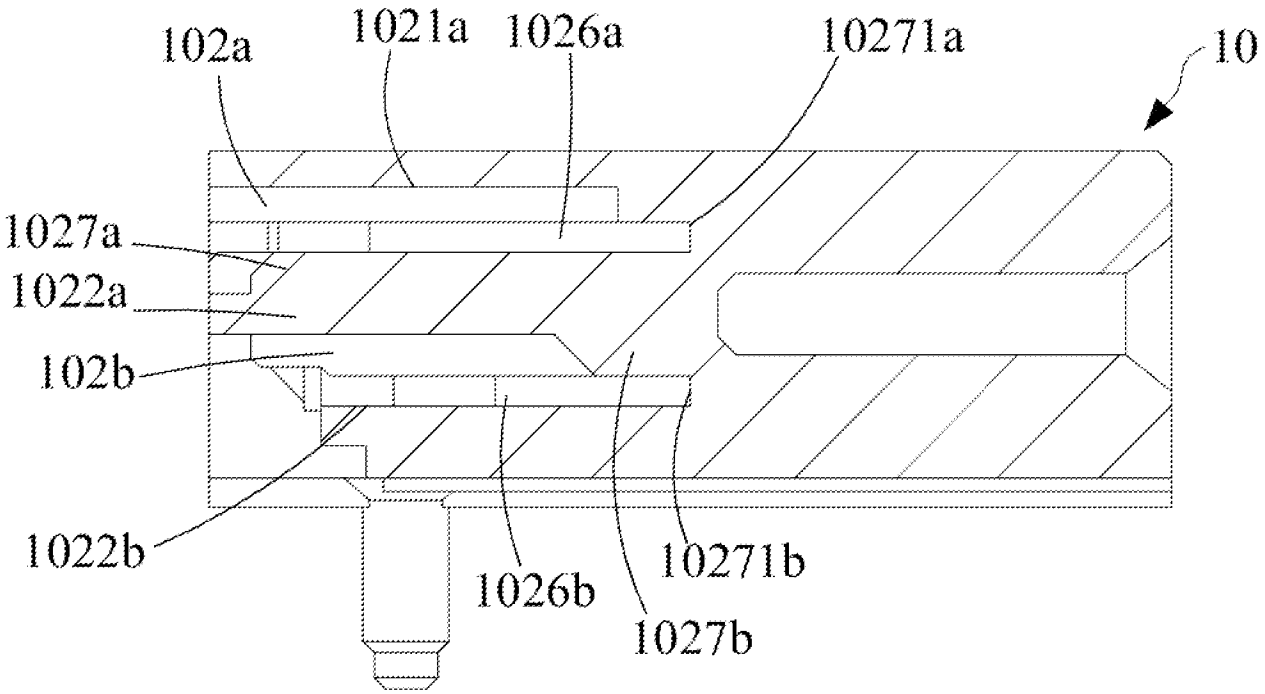
FIG. 12 is a cross-sectional view along line D-D' in FIG. 5.

FIG. 12 is a cross-sectional view along line D-D' in FIG. 5. As shown in the figure, each of the first partition members 1027*a* comprises a first limiting notch 10271*a* corresponding to two first positioning grooves 1026*a*. The first limiting notch 10271*a* penetrates the first rear surface 10*b* of the connector body 10. The terminal body 11*a* of the power terminal 11 in the first power terminal slot 102*a* is disposed in the first limiting notch 10271*a*. Each of the first partition members 1027*a* could also assist in positioning the location of the terminal body 11*a*. Similarly, the second partition member 1027*b* comprises a second limiting notch 10271*b* corresponding to two second positioning grooves 1026*b*. The second limiting notch 10271*b* penetrates the second rear surface 10*c* of the connector body 10. The terminal body 11*a* of the power terminal 11 in the second power terminal slot 102*b* is disposed in the second limiting notch 10271*b*. Each of the second partition members 1027*b* could also assist in positioning the location of the terminal body 11*a*.

The plurality of terminal slots of the connector body 10 of this embodiment further comprises a plurality of first signal terminal slots 103*a* and a plurality of second signal terminal slots 103*b*, which are disposed on the rear side of the connecting body 111, and on one side of the plurality of first power terminal slots 102*a* and the plurality of second power terminal slots 102*b*. The plurality of first signal terminal slots 103*a* are disposed above the plurality of second signal terminal slots 103*b*. The plurality of first signal terminal slots 103*a* correspond to the plurality of second signal terminal slots 103*b*, respectively. The plurality of first signal terminal slots 103*a* penetrate the first rear surface 10*b* of the connector body 10. The plurality of second signal terminal slots 103*b* penetrate the second rear surface 10*c* of the connector body 10. The electrical connector 1 of this embodiment further comprises a plurality of signal terminals 12, which are respectively disposed in the corresponding first signal terminal slot 103*a* or second signal terminal slot 103*b*.

The structural configuration of the signal terminal 12 of this embodiment is similar to that of the power terminal 11, comprising a terminal body, a plugging end part, and a connecting end part. The connecting end part of the signal terminal 12 of this embodiment also comprises a connecting body, a bent connecting member, and a connecting pin. The number of the bent connecting members and the connecting pins is one. The plugging end part of the signal terminal 12 also comprises a plugging elastic piece. The number of the plugging elastic pieces is also one.

In this embodiment, the structural configuration of the first signal terminal slot 103*a* is similar to that of the first power terminal slot 102*a*, and the differences come from the structural configuration of the signal terminal 12. In this embodiment, the first limiting block 1025*a* and the first partition member 1027*a* of the first power terminal slot 102*a* are omitted in the first signal terminal slot 103*a*. Similarly, the structural configuration of the second signal terminal slot 103*b* is similar to that of the second power terminal slot 102*b*, and the differences come from the structural configuration of the signal terminal 12. In this embodiment, the second limiting block 1025*b* and the second partition member 1027*b* of the second power terminal slot 102*b* are omitted in the second signal terminal slot 103*b*.

In other words, when the structural configuration of the signal terminal 12 is identical to that of the power terminal 11, the structural configuration of the first signal terminal slot 103*a* would be the same as that of the first power terminal slot 102*a*, and the structural configuration of the second signal terminal slot 103*b* would also be the same as that of the second power terminal slot 102*b*.

Figure 13:
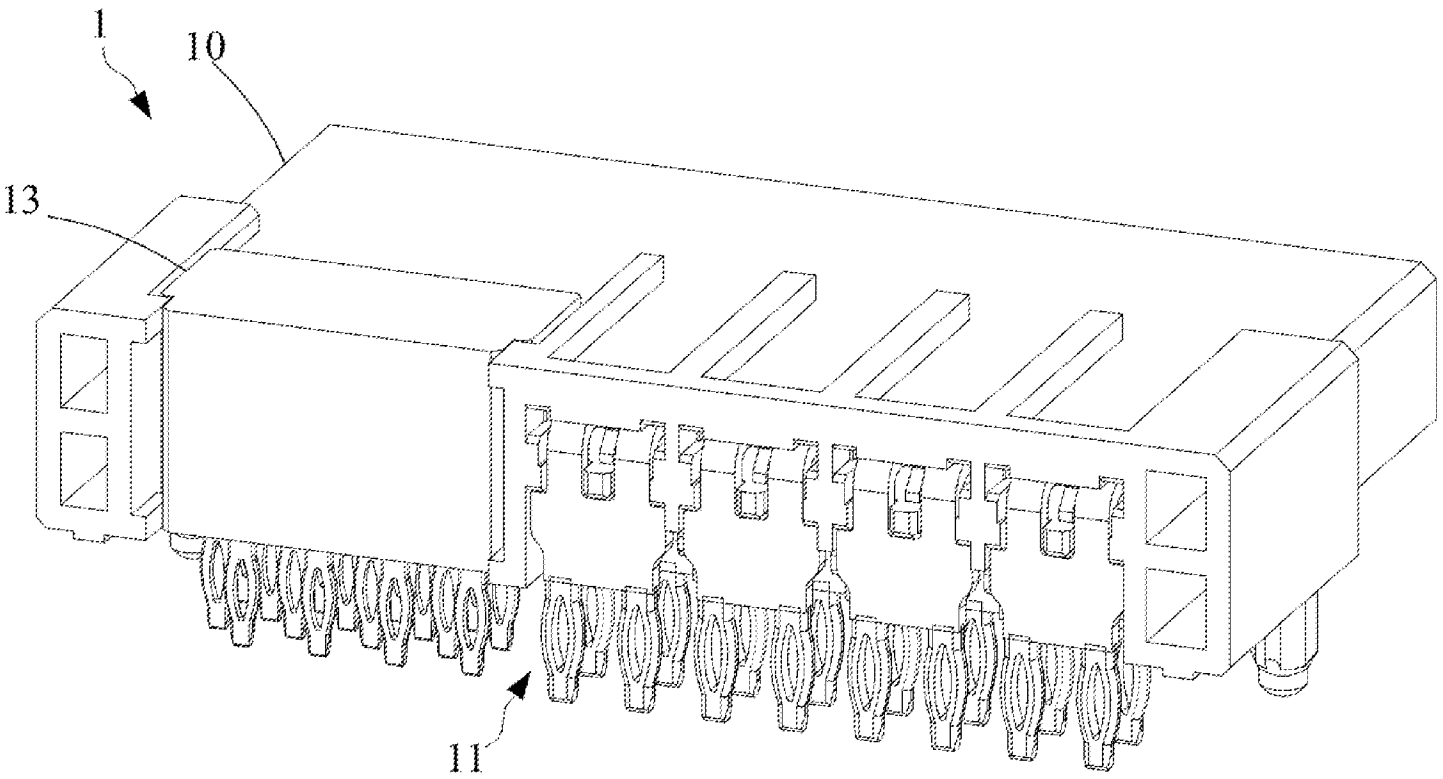
FIG. 13 is a perspective view of an electrical connector of the second embodiment of the present disclosure.
Figure 14:
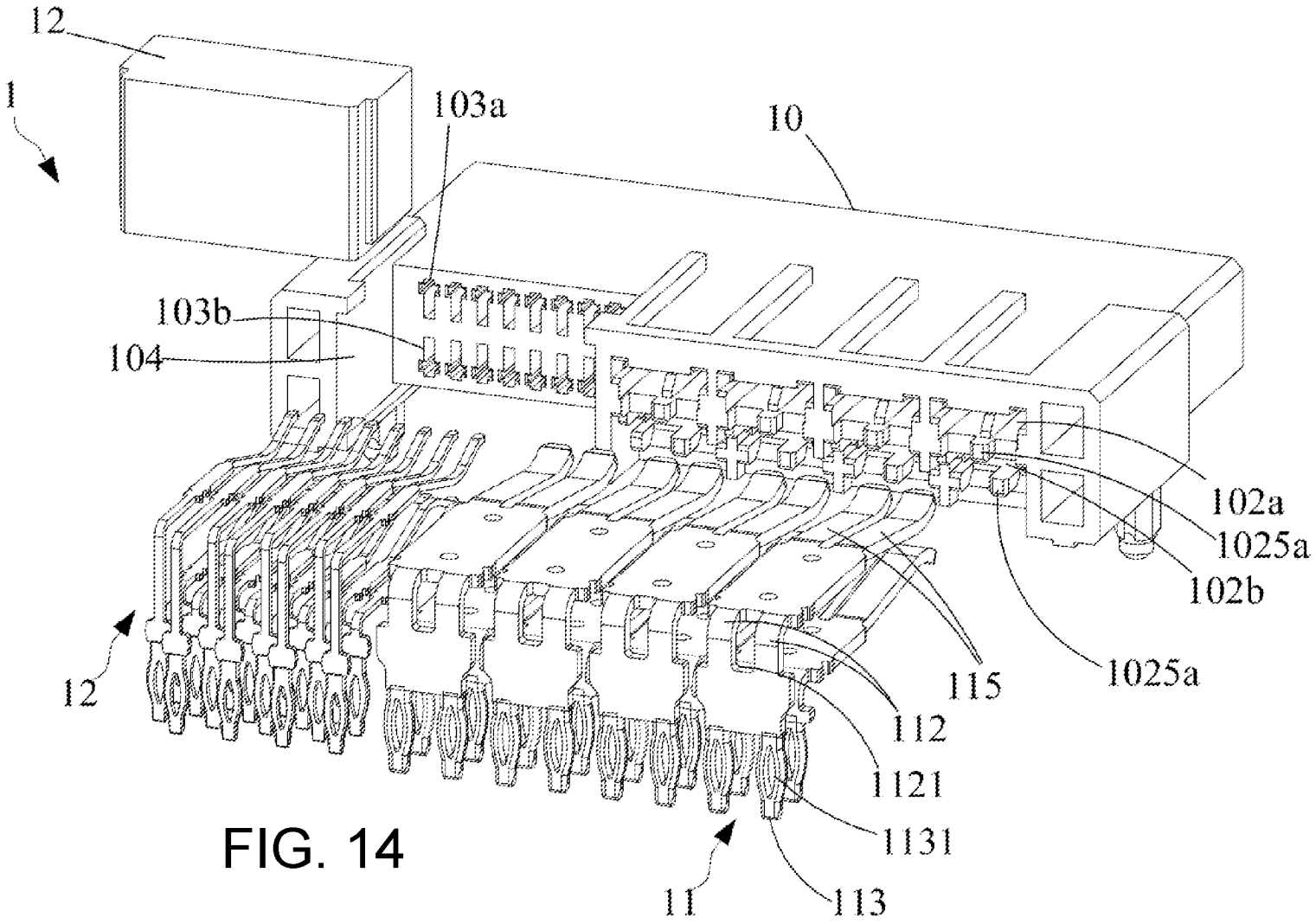
FIG. 14 is an exploded view of the electrical connector of the second embodiment of the present disclosure.
Figure 15:
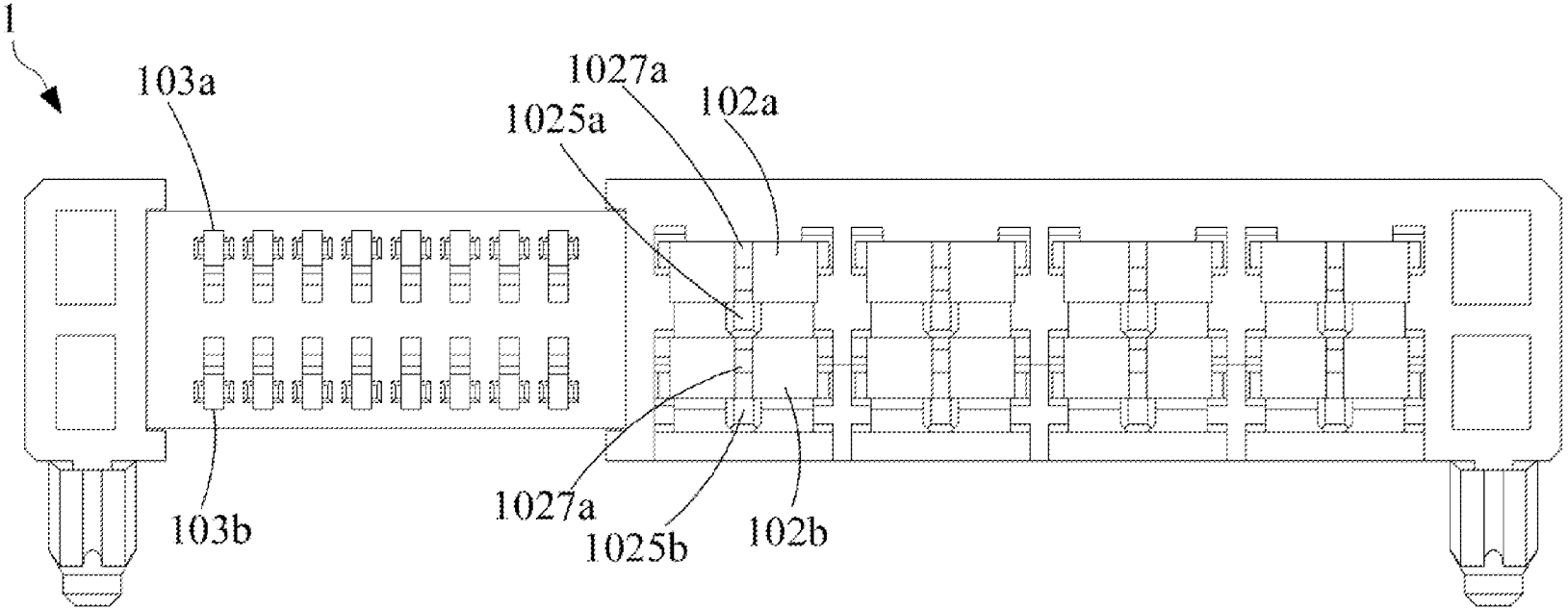
FIG. 15 is a rear view of the electrical connector of the second embodiment of the present disclosure.

FIG. 13 to FIG. 15 are perspective view, exploded view, and rear view of an electrical connector of the second embodiment of the present disclosure. As shown in the figures, the electrical connector 1 of this embodiment is different from that of the first embodiment in that the number of bent connecting members 112 of each of the power terminals 11 is two. Since one limiting gap 1121 is provided between two bent connecting members 112, the number of the first limiting blocks 1025*a* provided in the first power terminal slot 102*a* is one. Similarly, the number of the second limiting blocks 1025*b* provided in the second power terminal slot 102*b* is two.

In one embodiment, since the number of the plugging elastic pieces 115 of each of the power terminals 11 is two, the number of the first partition members 1027*a* provided in the first power terminal slot 102*a* is one. The structural configuration of each of the first partition members 1027*a* is identical to that of the first partition member of the first embodiment, so it would not be repeated herein. The two first partition members 1027*a* divide the inside part of the first power terminal slot 102*a* into two channels. The three plugging elastic pieces 115 of the power terminal 11 respectively pass through the corresponding channel. Similarly, the number of the second partition members 1027*b* provided in the second power terminal slot 102*b* is one. The structural configuration of each of the second partition members 1027*b* is identical to that of the second partition member of first embodiment, so it would not be repeated herein. The two second first partition members 1027*b* divide the inside part of the second power terminal slot 102*b* into two channels. The two plugging elastic pieces 115 of the power terminal 11 respectively pass through the corresponding channel. In this embodiment, the number of the connecting pins 113 of the power terminal 11 is two. Each of the connecting pins 113 comprises a press-fit component 1131. Each of the connecting pins 113 is press-fitted on an external circuit board through the press-fit component 1131.

In this embodiment, the connector body 10 comprises a cover accommodating notch 104 penetrating the rear surface of the connector body 10. The plurality of first signal terminal slots 103*a* and the plurality of second signal terminal slots 103*b* penetrate an end surface of the cover accommodating notch 104. The plurality of signal terminals 12 are disposed in the plurality of first signal terminal slots 103*a* and the plurality of second signal terminal slots 103*b*. The connecting end part of each of the signal terminals 12 is suspended in the cover accommodating notch 104, that is, it is not attached nor embedded on the end surface of the cover accommodating notch 104. Thus, the end surface of the cover accommodating notch 104 is a flat surface. Compared with the first signal terminal slot and the second signal terminal slot of the first embodiment, the accommodating recess is omitted in the first signal terminal slot 103*a* and the second signal terminal slot 103*b* of this embodiment. The electrical connector 1 of this embodiment further comprises a cover 13, which is disposed in the cover accommodating notch 104 and covers the plurality of signal terminals 12 in the cover accommodating notch 104.

Therefore, the number of limiting blocks in each of the terminal slots is determined by the number of bent connecting members 112 of each of the terminals. For example, when the number of the bending connecting members 112 is two, and the number of the limiting gaps 1121 between the two bending connecting members 112 is one, the number of the limiting blocks would be one; when the number of the bending connecting members 112 is three, and the number of the limiting gaps 1121 between the three bending connecting members 112 is two, the number of the limiting blocks would be two. Besides, the number of the partition members in each of the terminal slots is determined by the number of the plugging elastic pieces 115 of each of the terminals. For example, when the number of the plugging elastic pieces 115 is two, the number of the partition members would be one; when the number of the plugging elastic pieces 115 is three, the number of the partition members would be two.

In summary, embodiments of the present disclosure provide an electrical connector. By disposing an accommodating notch on the lower wall of the terminal slot and by disposing at least one limiting bump in the accommodating notch, the terminals exposed from the connector body can be restricted from moving toward the upper surface of the connector body. Thus, the terminal could avoid being pressed and move upward when the electrical connector is connected to the circuit board.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a connector body comprising a plugging slot and a plurality of terminal slots, the plurality of the terminal slots communicating with the plugging slot, a lower wall of each of the terminal slots comprising an accommodating recess, at least one limiting block being disposed on an end surface of the accommodating recess;

a plurality of terminals respectively disposed in the corresponding terminal slots, each of the terminals comprising a terminal body, a plugging end part and a connecting end part, the terminal body being disposed in the terminal slot, the plugging end part being disposed in the plugging slot, the connecting end part being disposed on a rear surface of the connector body, the connecting end part comprising at least two bent connecting members, a limiting gap existing between two adjacent bent connecting members, the at least two bent connecting members being connected to the terminal body, each of the limiting blocks passing through the corresponding limiting gap between two adjacent bent connecting members;

wherein two opposite sidewalls of the terminal slot comprise a positioning groove, respectively; the two positioning grooves are oppositely disposed; the terminal body of each of the terminals is disposed in the two positioning grooves.

2. The electrical connector according to claim 1, wherein the connecting end part comprises a connecting body and a connecting pin; one end of the connecting body is connected to one end of the at least two bent connecting members away from the terminal body; the connecting body extends perpendicularly to the terminal body; the connecting pin is connected to the connecting body away from the at least two bent connecting members.

3. The electrical connector according to claim 2, wherein two sides of the connecting body are respectively provided with a positioning bump; the positioning bump abuts against a lower surface of the lower wall of the terminal slot.

4. The electrical connector according to claim 2, wherein the connecting pin comprises a press-fit component.

5. The electrical connector according to claim 1, wherein the plugging end part comprises at least two plugging elastic pieces disposed on the terminal body at intervals; each of the terminal slots is provided with at least one partition member disposed between two adjacent plugging elastic pieces.

6. The electrical connector according to claim 1, wherein two sides of the terminal body of each of the terminals are respectively provided with an interfering bump; the interfering bump interferes with a sidewall of the positioning groove.

7. The electrical connector according to claim 1, wherein each of the partition members comprises a limiting notch corresponding to the positioning groove.

8. The electrical connector according to claim 1, wherein the rear surface of the connector body comprises a first rear surface and a second rear surface; the first rear surface is farther than the second rear surface away from a front surface of the connector body; the plurality of terminal slots comprise a plurality of first terminal slots and a plurality of second terminal slots; the plurality of first terminal slots are arranged in a row at intervals, penetrating the first rear surface; the plurality of second terminal slots are arranged in a row at intervals, penetrating the second rear surface; the plurality of first terminal slots correspond to the plurality of second terminal slots; the plurality of terminals are disposed in the plurality of first terminal slots and the plurality of second terminal slots.

9. The electrical connector according to claim 8, wherein the two positioning grooves of the first terminal slot are close to an upper surface of the connector body;

the two positioning grooves of the second terminal slot are close to a lower surface of the connector body.

10. The electrical connector according to claim 8, wherein the first terminal slot is a first power terminal slot or a first signal terminal slot; the second terminal slot is a second power terminal slot or a second signal terminal slot.

11. The electrical connector according to claim 1, wherein the terminal is a power terminal or a signal terminal.

* * * * *